US007600657B2

(12) United States Patent
Wang

(10) Patent No.: US 7,600,657 B2
(45) **Date of Patent: *Oct. 13, 2009**

(54) INTAKE STRUCTURE OF WATER BAG

(76) Inventor: Lo-Pin Wang, 16F. -2, No. 62, Sec. 2, Chongde 2nd Rd. Beitun District, Taichung City 406 (TW)

( * ) Notice: Subject to any disclaimer, the term of this patent is extended or adjusted under 35 U.S.C. 154(b) by 448 days.

This patent is subject to a terminal disclaimer.

(21) Appl. No.: 11/490,315

(22) Filed: Jul. 21, 2006

(65) Prior Publication Data

US 2008/0002922 A1 Jan. 3, 2008

(51) Int. Cl.
*B67D 5/64* (2006.01)

(52) U.S. Cl. ..... 222/175; 224/148.2

(58) Field of Classification Search ... 224/148.1–148.7; 222/175, 519–533, 74, 492; 220/703, 705, 220/714; 215/387–389; 383/904, 200, 35
See application file for complete search history.

(56) References Cited

U.S. PATENT DOCUMENTS

| | | | | |
|---|---|---|---|---|
| 4,448,316 | A * | 5/1984 | Hiroshige | 215/388 |
| 4,544,087 | A * | 10/1985 | Modig | 224/148.2 |
| 4,976,364 | A * | 12/1990 | Solomon | 215/229 |
| 6,085,947 | A * | 7/2000 | Lien | 222/525 |
| 6,742,681 | B1 * | 6/2004 | Yang | 222/509 |
| 2005/0029319 | A1 * | 2/2005 | Robins et al. | 224/148.2 |
| 2007/0164037 | A1 * | 7/2007 | Chen | 220/703 |

* cited by examiner

*Primary Examiner*—Lien T Ngo

(57) ABSTRACT

A water bag of the present invention includes a soft bag with an intake, a lid detachably covering the intake of the bag, a hose having an end connected to the bag and a mouthpiece connected to a free end of the hose. The hose has a water inlet to inject water into the soft bag and a cap detachably covering the water inlet. Therefore, water may be injected through the water inlet directly without having to take the soft bag out of the backpack.

20 Claims, 6 Drawing Sheets

INTAKE STRUCTURE OF WATER BAG

BACKGROUND OF THE INVENTION

1. Field of the Invention

The present invention relates generally a portable water bag, and more particularly to an intake structure of the water bag.

2. Description of the Related Art

Portable water bags are the common equipments of jogging, mountain-climbing, bicycle riding and so on. Typically, the conventional portable water bag includes a soft bag to be received in a backpack or in a specific pack. The bag has an intake to pour water into the bag, a lid to close the intake, a hose with an end connected to the bag, mouthpiece connected to a free end of the hose. People may suck water in the bag through the mouthpiece or just pour water on head or body to get cool. Such water bag is filled with water first, and then carried on back for drinking. If the water bag need to refill, people has to take the bag off, pour water into the bag, and then put it back to the backpack or specific pack. The refill action of the conventional water bag is inconvenient to user.

SUMMARY OF THE INVENTION

The primary objective of the present invention is to provide a water bag, which has an easier way to refill water.

According to the objective of the present invention, a water bag includes a soft bag with an intake, a lid detachably covering the intake of the bag, a hose having en end connected to the bag and a mouthpiece connected to a free end of the hose. The hose has a water inlet to inject water into the soft bag and a cap detachably covering the water inlet. Therefore, water may be injected through the water inlet directly without having to take the soft bag out of the backpack.

Another character of the present invention is the water inlet of the present invention fits to a common mineral water bottle, such that user only needs to engage the mineral water bottle with the water inlet, and water in the water bottle will flow to the soft bag.

BRIEF DESCRIPTION OF THE DRAWINGS

FIG. 4 is sectional view along 4-4 line of FIG. 3, showing the switch on;

DETAILED DESCRIPTION OF THE INVENTION

Figure 1:
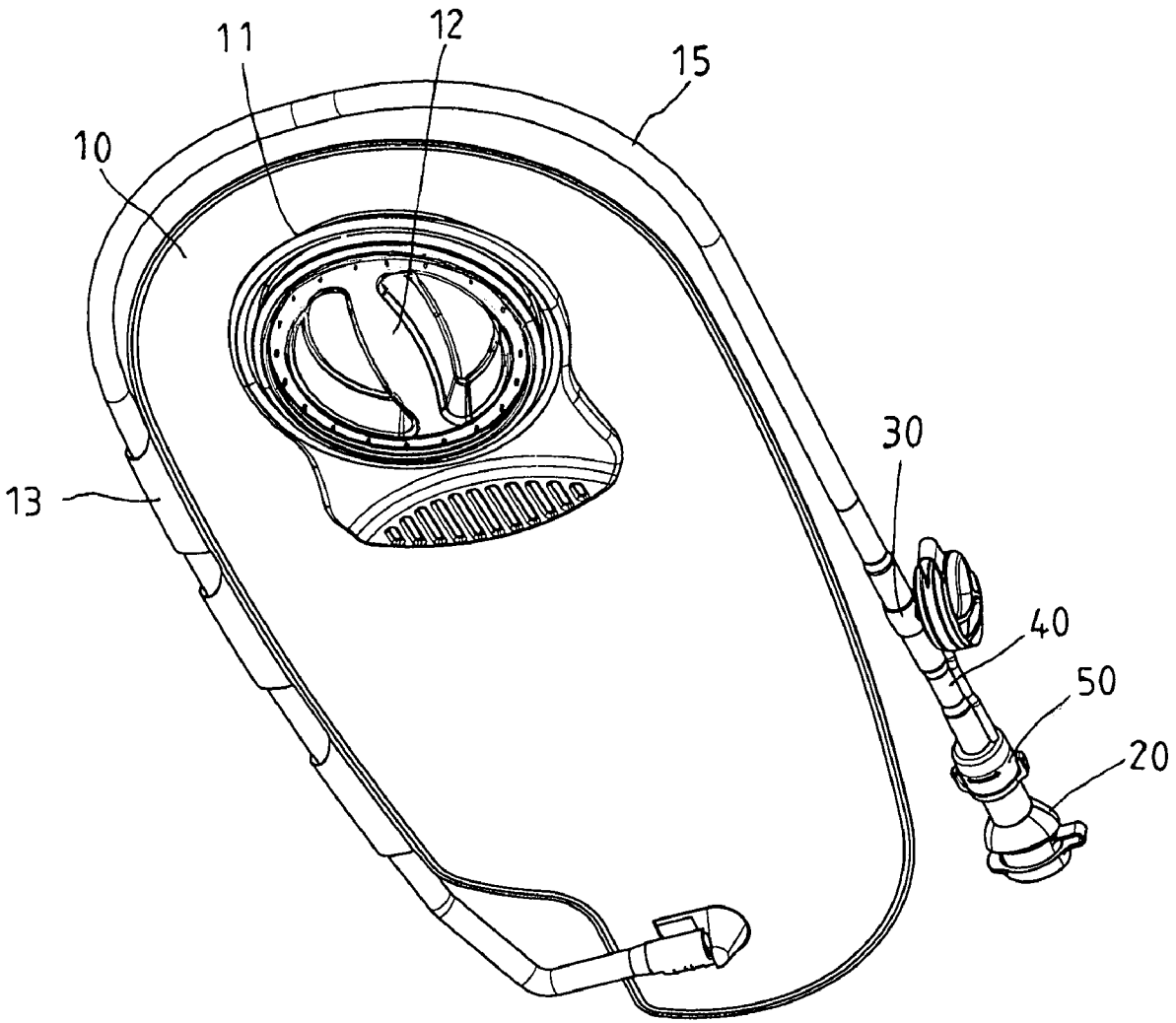
FIG. 1 is a perspective view of a preferred embodiment of the present invention.
Figure 2:
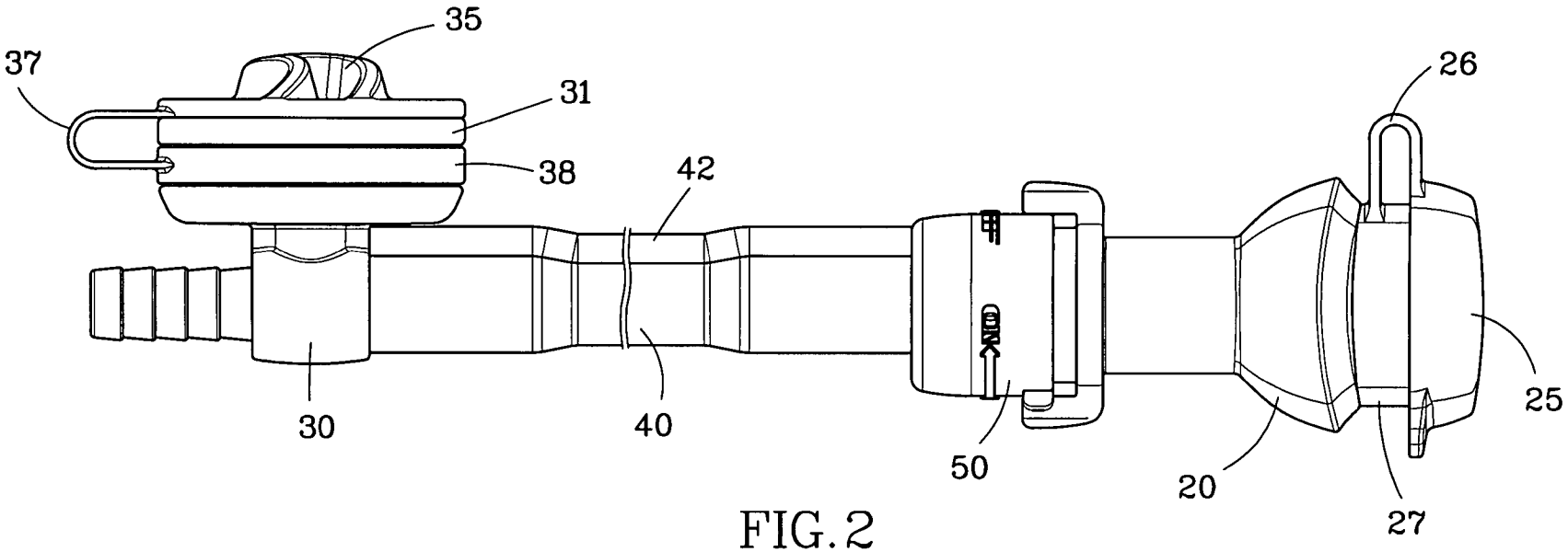
FIG. 2 is a front view of the preferred embodiment of the present invention.
Figure 3:
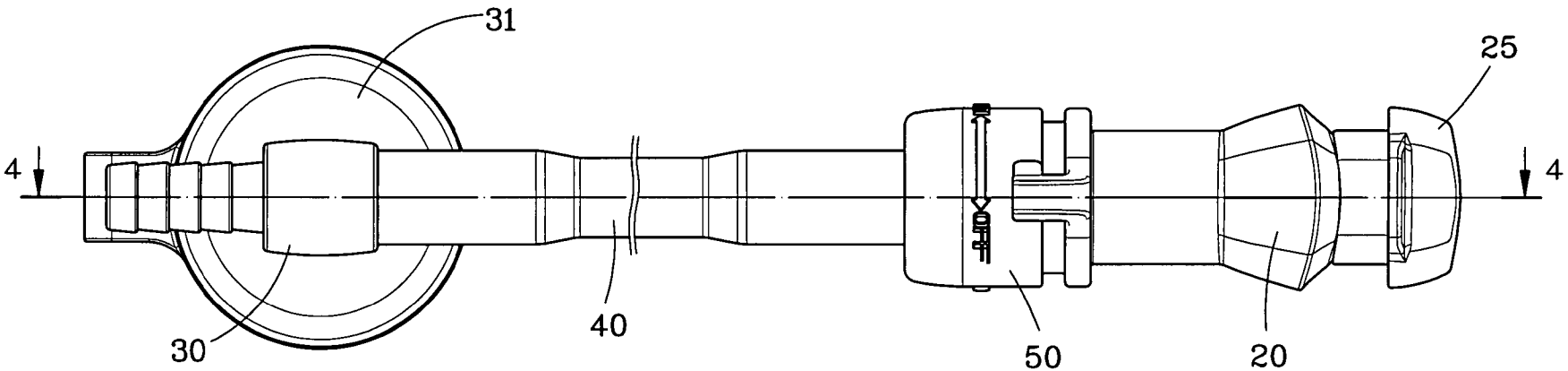
FIG. 3 is a bottom view of the preferred embodiment of the present invention.

As shown in FIG. 1, a water bag of the preferred embodiment of the present invention includes:

A soft bag 10 has an intake 11.

A lid 12 covers the intake 11 to close or open the intake 11.

A hose 15 has an end connected to the bag 10. The bag 10 has three rings 13 on a side for the hose 15 passing through.

A mouthpiece 20 is connected to a free end of the hose 15.

A three-way valve 30 has a first end connected to the hose 15, a second end connected to the mouthpiece 20 and a third end forming a water inlet 31. On an interior wall of the water inlet 31 of the connector three-way 30, a threaded section 32 is provided. The water inlet 31 may be engaged with a common mineral water bottle, as shown in FIG. 7.

A cap 35 has a threaded section 36 to be screwed to a threaded section 32 of the water inlet 31. The cap 35 is provided with a strip 37 and a ring 38 on an end of the strip 37. The ring 38 is fitted to an annular slot 33 on the three-way valve 30 adjacent to the water inlet 31, such that the cover will not loose when the cap 35 is opened. A leakage-proof ring 34 is provided in the cap 35 to press the three-way valve 30 when the cap 35 is screwed onto the three-way valve 30 for leakage-proof.

Figures 7, 8:
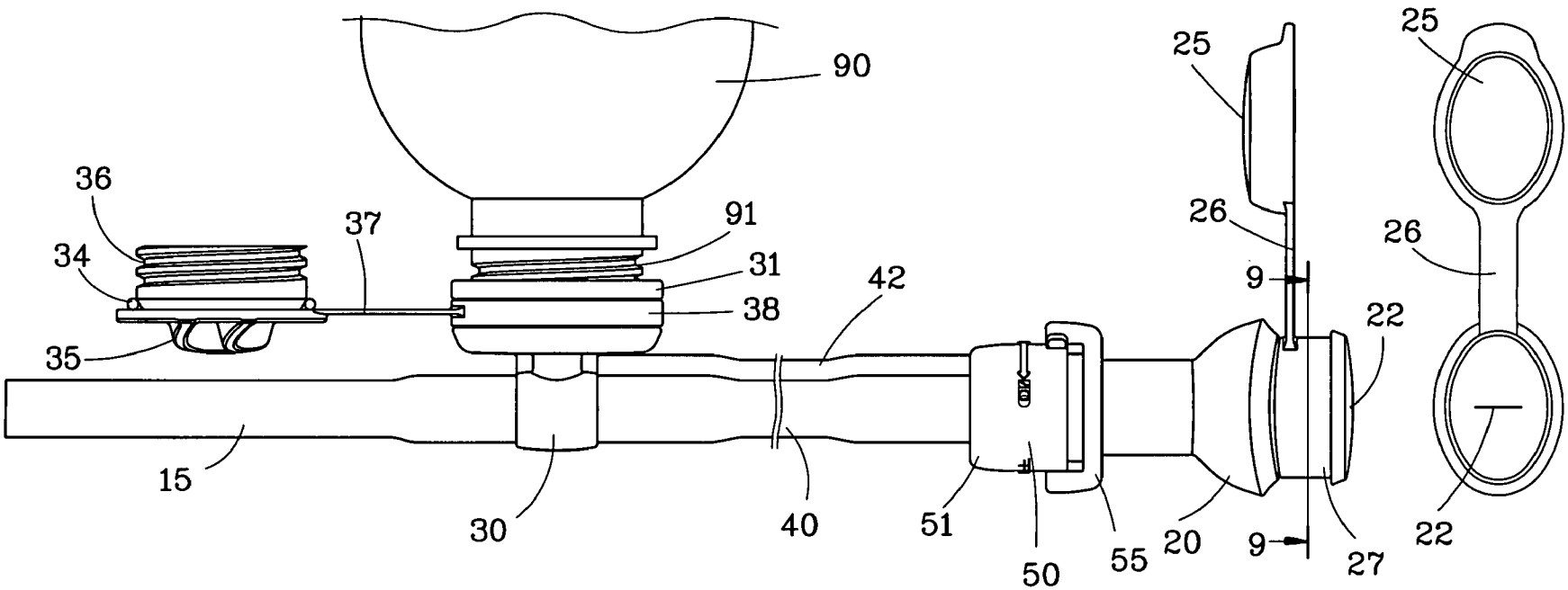
FIG. 7 is a sketch diagram, showing the present invention in operation.
FIG. 8 is a right view of FIG. 7, showing the aspect of the opening.

When water in the bag 10 is out, user may open the cap 35 and engage an opening 91 of a common water bottle 90 with the water inlet 31, as shown in FIG. 7, to inject water into the bag 10 through the hose 15. After filling, user only needs to close the cap 35 that is a very convenient operation.

In addition, to for convenience of operation, a plastic deformation tube 40, which may be bent and fixed in a predetermined shape, is mounted between the three-way valve 30 and the mouthpiece 20. The plastic deformation tube 40 includes a main tube 41, a sub-tube 42 attached on a circumference of the main tube 41, and a metal bar 43 in the sub-tube 42. The metal bar 43 may be bent and fixed at that shape. With the plastic deformation tube 40, user may adjust the mouthpiece 20 at desired positions, such that user may drink water without having to hold the mouthpiece 20.

Figure 4:
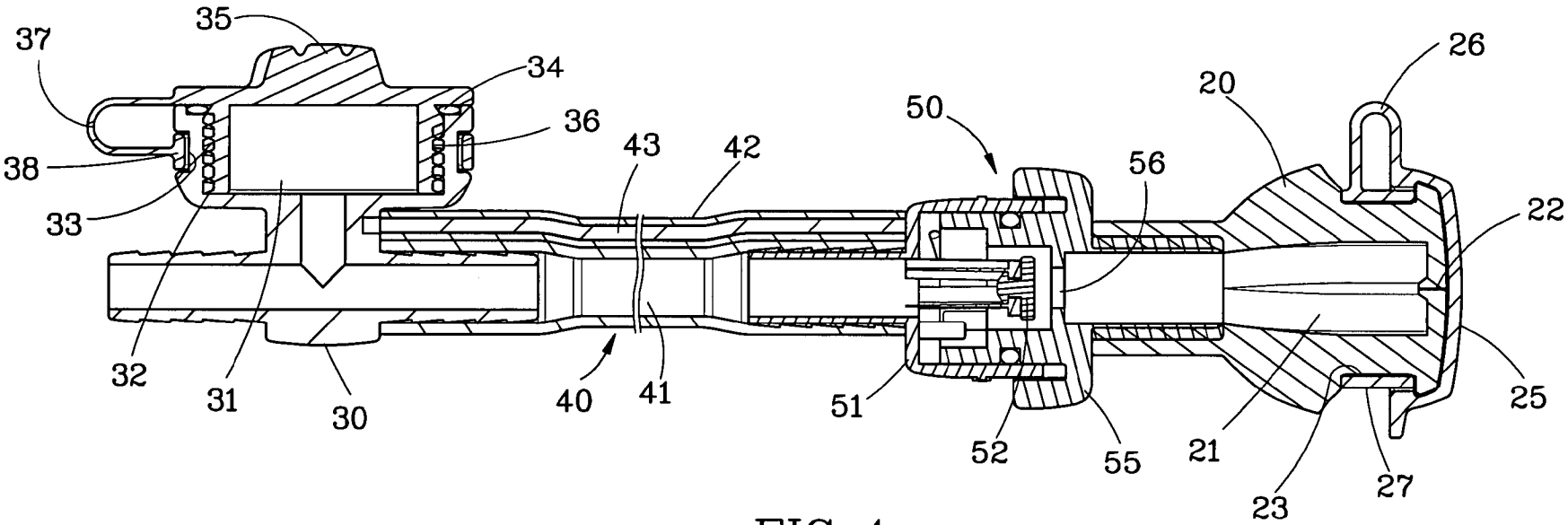
Figure 5:
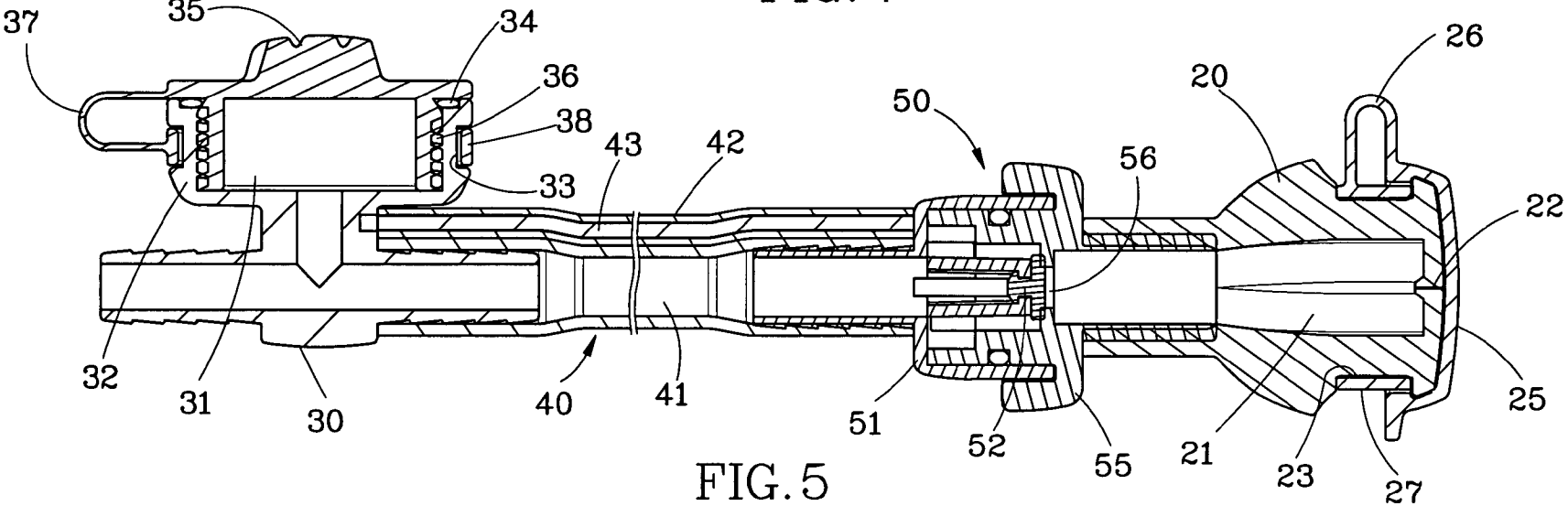
FIG. 5 is similar to FIG. 4, showing the switch off.
Figure 6:
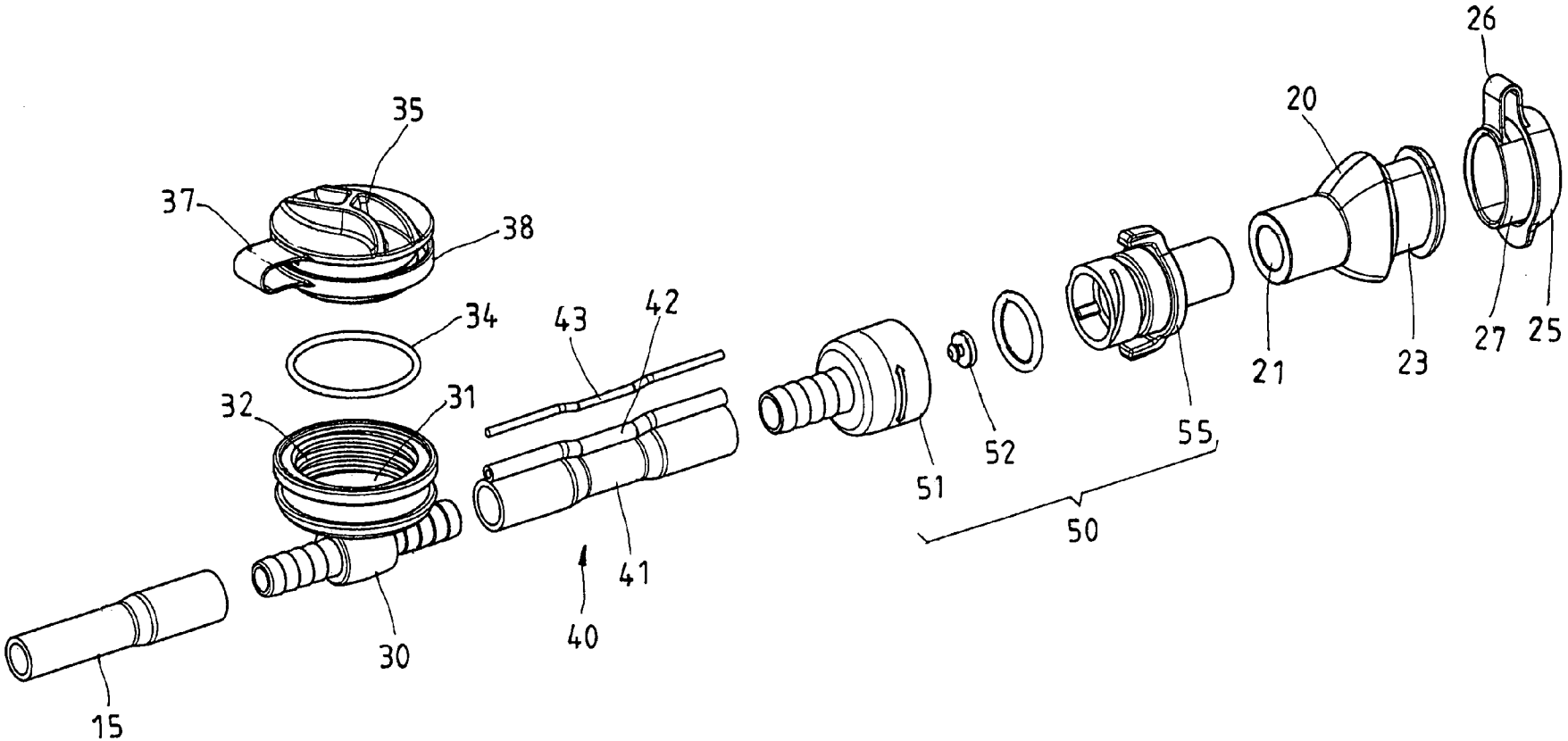
FIG. 6 is an exploded view of the preferred embodiment of the present invention.

The water bag of the present invention is further provided with a switch 50 between the plastic deformation tube 40. The switch 50 includes two members 51, 55, in which the first member 51 is connected to the plastic deformation tube 40 and the second member is connected to the mouthpiece 20. The members 51, 55 are connected together and may be rotated relative to each other. The second member 55 as a tunnel 56, and the first member 51 has a plug 52. When the members 51, 55 are turned, the first member 51 may be moved away from the second member 55, as shown in FIG. 4, in which water may flow through the switch 50. The members 51, 55 also may be turned in opposite direction to have the first member 51 moved toward the second member 55, as shown in FIG. 5, in which plug 52 seals the tunnel 56 to cut off water.

The mouthpiece 20 includes a flexible body, in which a tunnel 21 is provided, with a closed end. On the closed end of the tunnel 21, an elongated crack 22 is provided, as shown in FIG. 8. The crack 22 is closed in a normal condition, such that water will not flow out, and it is opened when the flexible body is compressed along an elongated direction of the crack 22, such that water may flow out. A cap 25 covers the closed end of the mouthpiece 20 with a strip 26 and a ring 27. The ring 27 is fitted to a slot 23 on a circumference of the mouthpiece 20, such that the cap 25 will not loose. The main purpose of the cap 25 is dustproof, except that the cap 25 compresses the mouthpiece 20 to seal the crack 22 for leakage proof when the cap 25 is covered on the mouthpiece 20. The ring 27 may restrict the flexible body to ensure the crack 22 closed.

Figure 9:
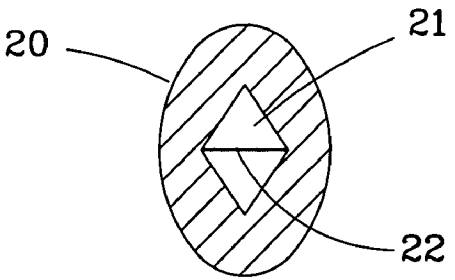
FIG. 9 is a sectional view of along 9-9 line of FIG. 7.

As shown in FIG. 9, the tunnel 21 has a quadrilateral section 24, such as rhombus, square or rectangle, adjacent to the closed end. The crack 22 extends along a diagonal line of the quadrilateral section 24. The present embodiment shows the crack 22 extends along a short diagonal line of the rhomboidal section 24 that benefits the crack 22 to keep closed.

Figure 10:
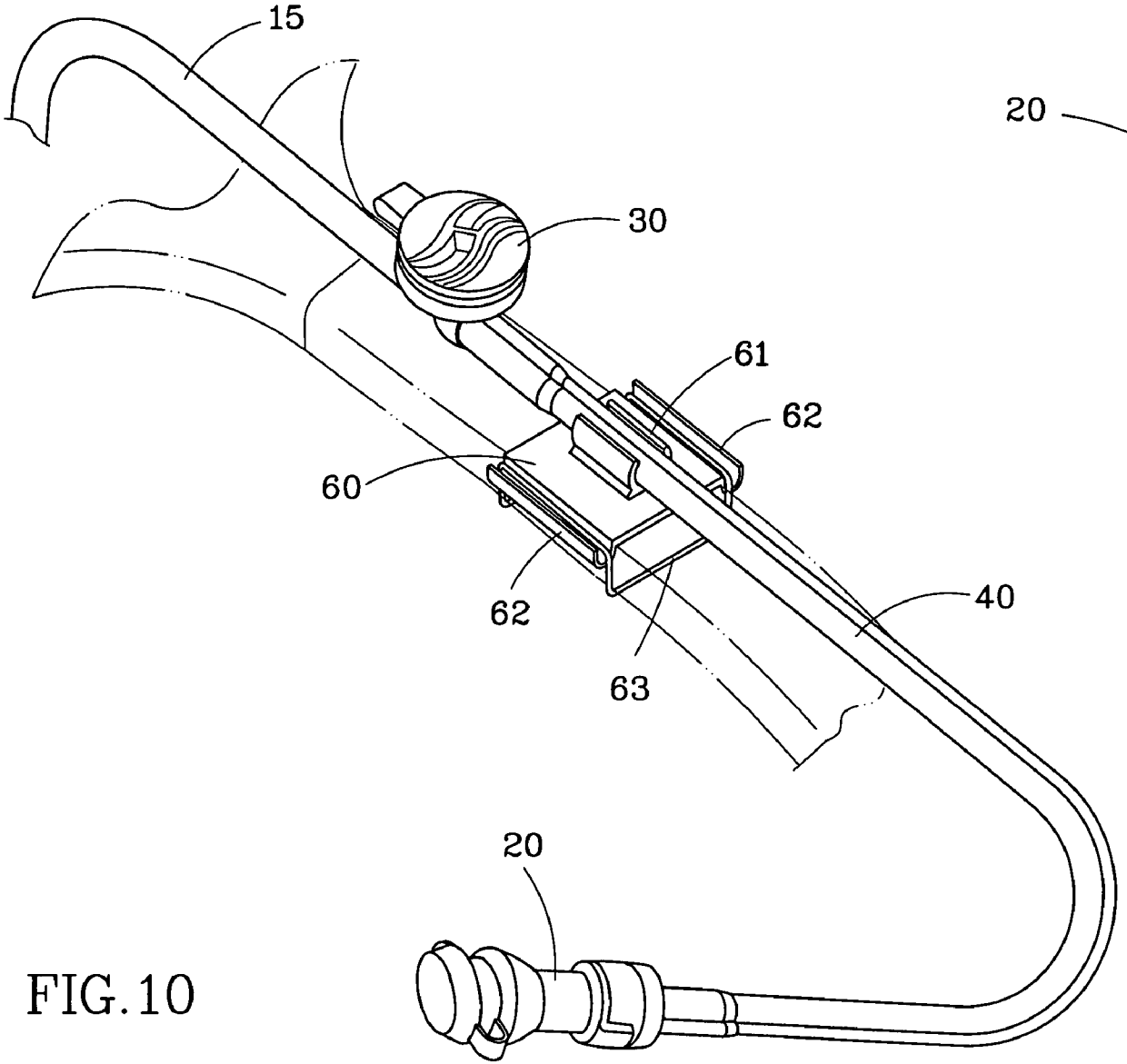
FIG. 10 is a perspective view of the preferred embodiment of the present invention, showing a lock device securing the hose.

As shown in FIG. 10, the present invention further provides a lock device 60, which is an elongated plate with a C-shaped clip 61 on a center thereof and two connectors 62 on opposite sides of the clip 61. The clip 61 may hold the plastic deformation tube 40 or the hose 15. The connectors 62 may connect an O-ring 63 (or elastic band). The O-ring 63 is wound on a back of a belt of a backpack and engages opposite ends thereof with the connectors 62 to mount the lock device 60 on the backpack, such that the plastic deformation tube 40 may be fixed on the lock device 60. User may adjust the plastic deformation tube 40 to have the mouthpiece at a suitable position for drinking.

The description above is a few preferred embodiments of the present invention and the equivalence of the present invention is still in the scope of the claim of the present invention.

What is claimed is:

1. A water bag, comprising:

a soft bag with an intake;

a lid detachably covering the intake of the bag;

a hose having an end connected to the bag; and a mouthpiece connected to a free end of the hose;

the hose having a water inlet to inject water into the soft bag and a cap detachably covering the water inlet.

2. The water bag as defined in claim 1, further comprising a three-way valve between the mouthpiece and the hose, which has a first end and a second end connected to the mouthpiece and the hose and a third end forming the water inlet.

3. The water bag as defined in claim 2, wherein the three-way valve has a threaded section on an interior side of the water inlet to be engaged with a water bottle.

4. The water bag as defined in claim 3, wherein the cap has a threaded section to be engaged with the threaded section of the three-way valve.

5. The water bag as defined in claim 4, further comprising a leakage-proof ring between the cap and the water inlet of the three-way valve.

6. The water bag as defined in claim 5, wherein the leakage-proof ring is provided on the cap next to the threaded section.

7. The water bag as defined in claim 1, wherein on an exterior side of the water inlet, a slot is provided, and the cap has a strip and a ring on a free end of the strip to be fitted to the slot.

8. The water bag as defined in claim 2, further comprising a plastic deformation tube between the second end of the three-way valve and the mouthpiece.

9. The water bag as defined in claim 8, wherein the plastic deformation tube includes a main tube and a metal bar fixed to the main tube, such that the main tube may be bent and fixed at any shape.

10. The water bag as defined in claim 9, wherein the main tube has a sub-tube, in which the metal bar is received.

11. The water bag as defined in claim 8, further comprising a switch between the plastic deformation tube and the mouthpiece.

12. The water bag as defined in claim 11, wherein the switch includes two members connected together and rotated relative to each other, one of which has a tunnel and the other of which has a plug, such that the plug may be moved toward the tunnel and seal the tunnel when the members are turned to a direction, and the plug may be moved away from the tunnel when the members are turned to an opposite direction.

13. The water bag as defined in claim 1, wherein the mouthpiece has a flexible body with a tunnel therein, a closed end, and an elongated crack on the closed end, such that the crack is closed at a normal condition and is opened when the flexible body is pressed along an elongated direction of the crack.

14. The water bag as defined in claim 13, wherein the mouthpiece further has a cap detachably covering the closed end of the flexible body.

15. The water bag as defined in claim 14, wherein the mouthpiece has a slot, and the cap has a strip and a ring on a free end of the strip to be fitted to the slot of the mouthpiece.

16. The water bag as defined in claim 13, wherein the tunnel has a quadrilateral section adjacent to the crack, and the elongated direction of the crack extends along a diagonal line of the quadrilateral section.

17. The water bag as defined in claim 16, wherein the elongated direction of the crack extends along a short diagonal line of the quadrilateral section.

18. The water bag as defined in claim 1, further comprising a lock device to be mounted on a belt of a backpack to hold the hose.

19. The liquid crystal display as defined in claim 18, wherein the lock device has a C-shaped clip to hold the hose.

20. The water bag as defined in claim 8, further comprising a lock device to be mounted on a belt of a backpack to hold the plastic deformation tube.

* * * * *